US007028599B2

(12) United States Patent
Linser

(10) Patent No.: US 7,028,599 B2
(45) Date of Patent: Apr. 18, 2006

(54) CONTROL DEVICE FOR THE CONTINUOUS DRIVE OF A HYDRAULIC CONTROL MOTOR

(75) Inventor: Joerg Linser, Heubach (DE)

(73) Assignee: ZF Lenksysteme GmbH, Schwaebisch Gmuend (DE)

( * ) Notice: Subject to any disclaimer, the term of this patent is extended or adjusted under 35 U.S.C. 154(b) by 92 days.

(21) Appl. No.: 10/486,483

(22) PCT Filed: Aug. 10, 2001

(86) PCT No.: PCT/EP01/09264

§ 371 (c)(1),
(2), (4) Date: Feb. 10, 2004

(87) PCT Pub. No.: WO03/014576

PCT Pub. Date: Feb. 20, 2003

(65) Prior Publication Data

US 2004/0187675 A1 Sep. 30, 2004

(51) Int. Cl.
*F15B 13/04* (2006.01)

(52) U.S. Cl. ..... 91/454; 91/461; 60/422

(58) Field of Classification Search ..... 91/454, 91/461; 60/422

See application file for complete search history.

(56) References Cited

U.S. PATENT DOCUMENTS 2,672,731 A * 3/1954 Ashton ..... 91/454
3,433,131 A * 3/1969 Soyland et al. ..... 91/454
4,201,052 A * 5/1980 Breeden et al. ..... 91/454
4,437,385 A * 3/1984 Kramer et al. ..... 91/461
4,830,131 A 5/1989 Miyoshi et al.
5,979,498 A 11/1999 Zenker et al.
6,691,604 B1 * 2/2004 Hajek et al. ..... 91/454

FOREIGN PATENT DOCUMENTS

DE 196 01 662 7/1997
JP 63-188574 8/1988

OTHER PUBLICATIONS

Patent Abstracts of Japan, vol. 012, No. 464 (M-771), Dec. 6, 1988.

* cited by examiner

*Primary Examiner*—Edward K. Look
*Assistant Examiner*—Igor Kershteyn
(74) *Attorney, Agent, or Firm*—Kenyon & Kenyon LLP

(57) ABSTRACT

In series between pump and tank are two throttle devices, one of which includes a controllable throttle valve having a piston, of which one side supports a valve head, which forms the boundary of an annular gap between an inflow duct and an outflow duct. A hydraulic control path extends from the inflow duct through the throttle opening to the tank, running through a precontrol bore in the piston. To prevent an unwanted leakage fluid stream, one end of the precontrol bore at the annular gap in the region of the inflow duct is positioned so that it remains opened for a closed annular gap, and the other end of the precontrol bore on the other side of the piston is arranged where the piston, in response to the controllable throttle valve being completely opened, pushes against a stop face and, in so doing, automatically closes this other end.

14 Claims, 4 Drawing Sheets

CONTROL DEVICE FOR THE CONTINUOUS DRIVE OF A HYDRAULIC CONTROL MOTOR

FIELD OF THE INVENTION

The present invention relates to a control device for the continuous motion of a hydraulic control motor.

BACKGROUND INFORMATION

Proportional valve arrangements, as are used, for example, as servo valve arrangements for operating a hydraulic control motor in the form of, e.g. a working cylinder 27 (FIG. 1), may be made up of individual modules D1 through D4. In the form of closing valves that are precontrolled and controlled in a pressure-proportional manner, these modules then form four controllable throttle devices D1, D2, D3, D4 of a hydraulic bridge circuit represented in FIG. 1.

Figure 1:
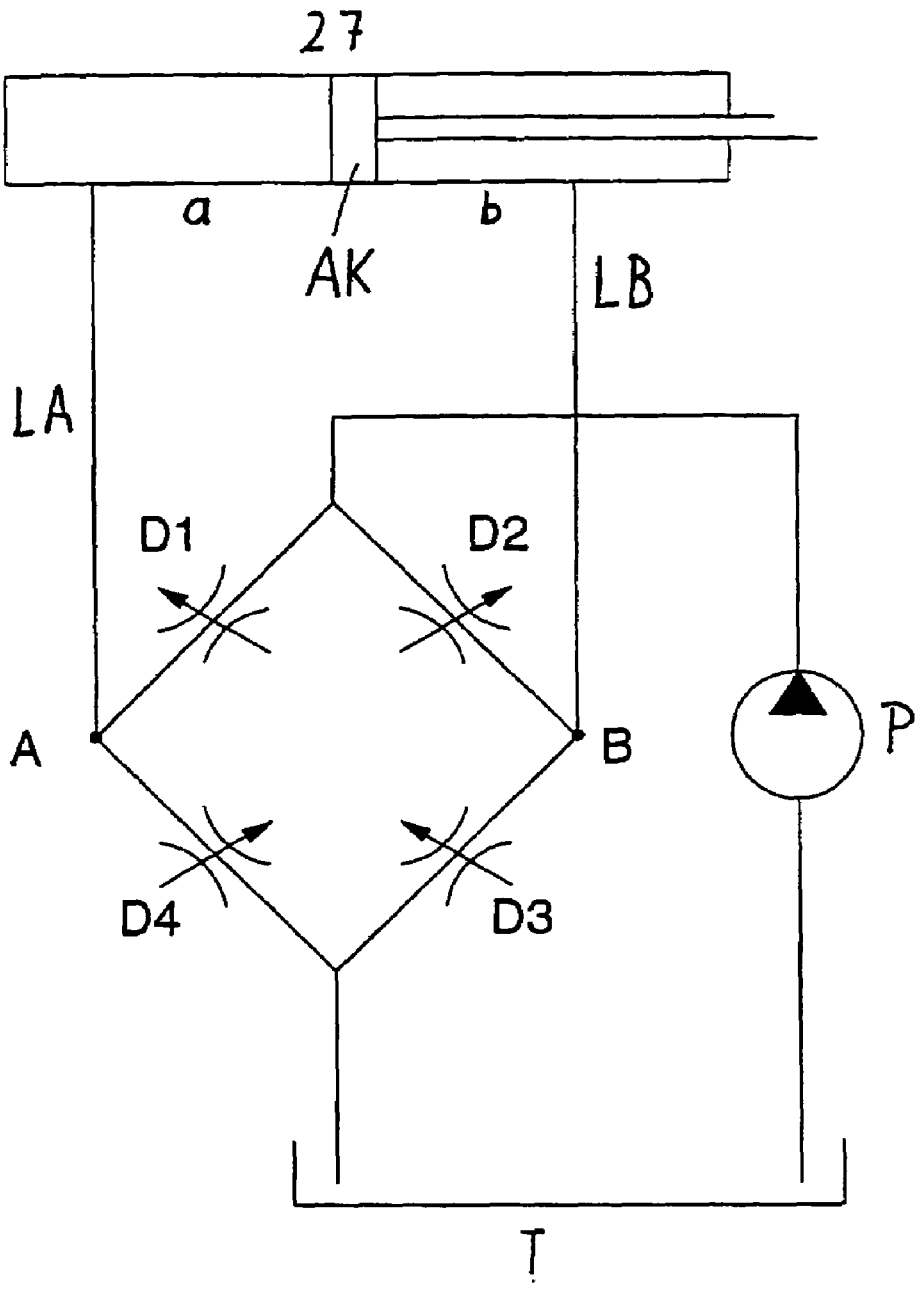

FIG. 1 shows the basic circuit diagram of the so-called open-center variant (variant according to the open-principal) of such a servo valve arrangement, in the neutral position, in which all four throttle devices are open, so that a fluid conveyed by a pump P from a tank T may flow back nearly unhindered through the throttle devices to tank T. Lines LA and LB run from points A and B, respectively, to working chambers a and b, respectively, of working cylinder 27, which are separated from each other by a working piston AK. In the neutral position shown, the pressure in the two working chambers a, b is the same, so that working piston AK remains at rest.

Not all modules D1 through D4 must be controllable. In order to be able to control the movement of the working piston, it is basically sufficient to have a series connection of two throttle devices D1 and D4, of which one must be controllable. In this context, the working piston may be provided a spring, which pushes it in a direction, or working chamber b may be kept at another controlled or constant pressure, whose magnitude is between the pump pressure and the pressure of the tank (mostly atmospheric pressure).

DETAILED DESCRIPTION

The present invention relates to a controllable module (e.g., D1) or a pair of modules (e.g., D1 with D3). According to FIG. 2, such a module D1 is basically made up of a housing bore 1, which is introduced into a valve block (housing G), and in which a piston 3 may be moved axially back and forth. A sealing element 4 on the circumference of the piston separates pressure chambers 2 and 5 from each other and simultaneously functions as a low-friction guide of piston 3 in housing bore 1. If the fluid flow indicated by arrows, from an inflow duct 14, through an annular gap 17, to a discharge duct 13 is reduced or completely interrupted, a throttle needle 9 is moved into a throttle opening 8 by an actuating force. This throttle opening 8 is arranged in a fixed disk 6, which may also be integrated into a housing G or a cover D and forms, together with piston 3 and housing bore 1, pressure chamber 5. The axial actuating force on throttle needle 9 may be applied mechanically, electromotively, electromagnetically, hydraulically, pneumatically, etc. The insertion of throttle needle 9 into throttle opening 8 reduces the flow cross-section for the fluid stream flowing through a choke bore 12 into a tank T, via a duct 10. This throttling of the fluid stream causes a high pressure to build up in pressure chamber 5. Piston 3 is moved in the direction of annular gap 17 as a result of the imbalance between, on one hand, the forces acting on the left side of piston 3 and, on the other hand, the forces acting on the right side of piston 3. This reduces the width of annular gap 17, which produces the connection of inflow duct 14 to outflow duct 13. Consequently, the fluid pressure in inflow duct 14 increases. The fluid pressure in chamber 5 is proportional to the actuating force on throttle needle 9. This fluid pressure is proportional to the fluid pressure in inflow duct 14, which means that, on the whole, a proportionately is established between the actuating force acting on throttle needle 9 and the fluid pressure produced in inflow duct 14.

Figure 3:
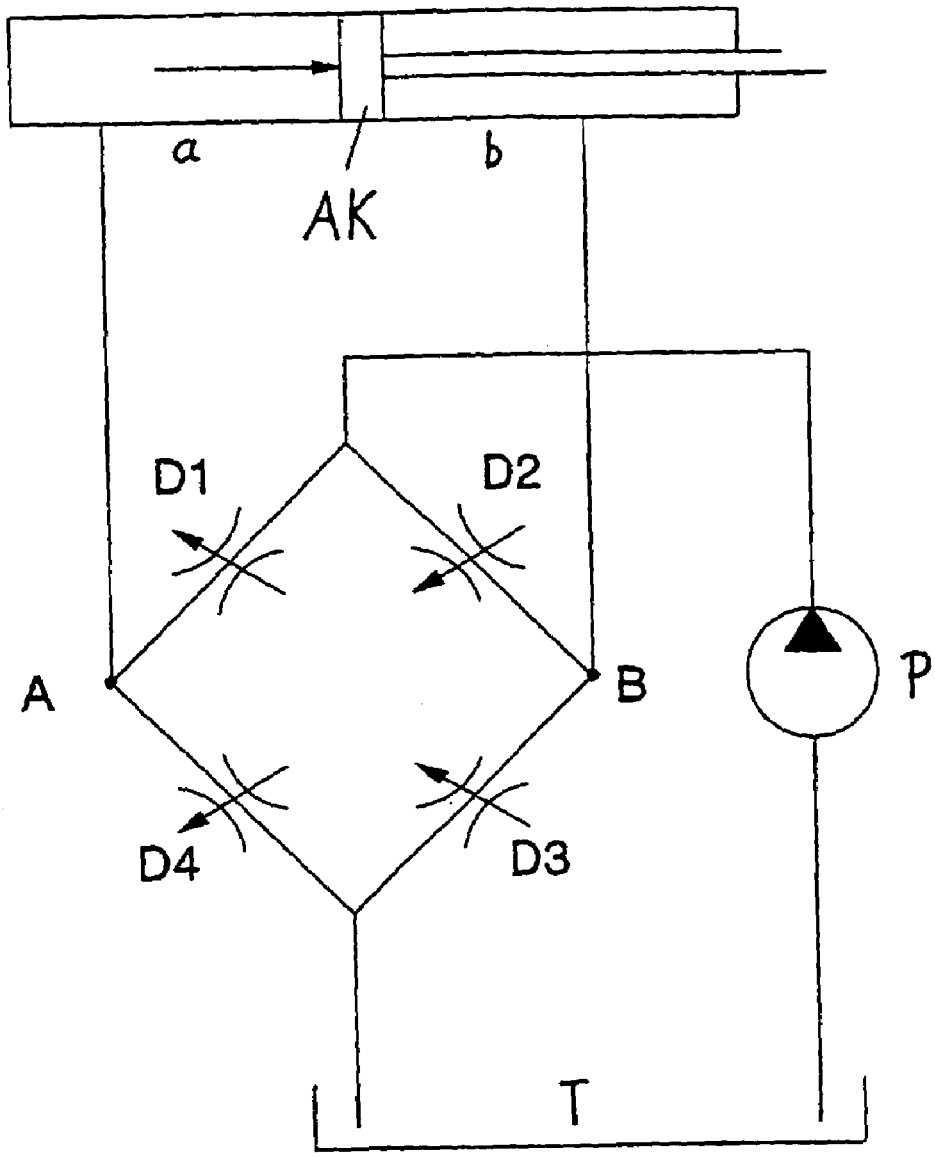

When two such modules D1, D3 of a total of four modules carry out the same closing function, cf. FIG. 3, for the functioning of a hydraulic bridge circuit, as may be conventional in the case of servo valves, then these modules may be designed to have a nearly identical construction and to be jointly controlled by the throttle unit of one module D1, made up of throttle needle 9 and throttle opening 8. For this joint control, a hydraulic connection is provided between, on one hand, pressure chamber 5 of a module D1 provided with a throttle unit, and, on the other hand, the corresponding pressure chamber (53 in FIG. 4) of one or more other modules, which are then constructed without a throttle unit and a choke bore 12, and are also controlled. The hydraulic connection may be constructed in the form of an internal housing duct (1_3 in FIG. 4).

Figure 4:
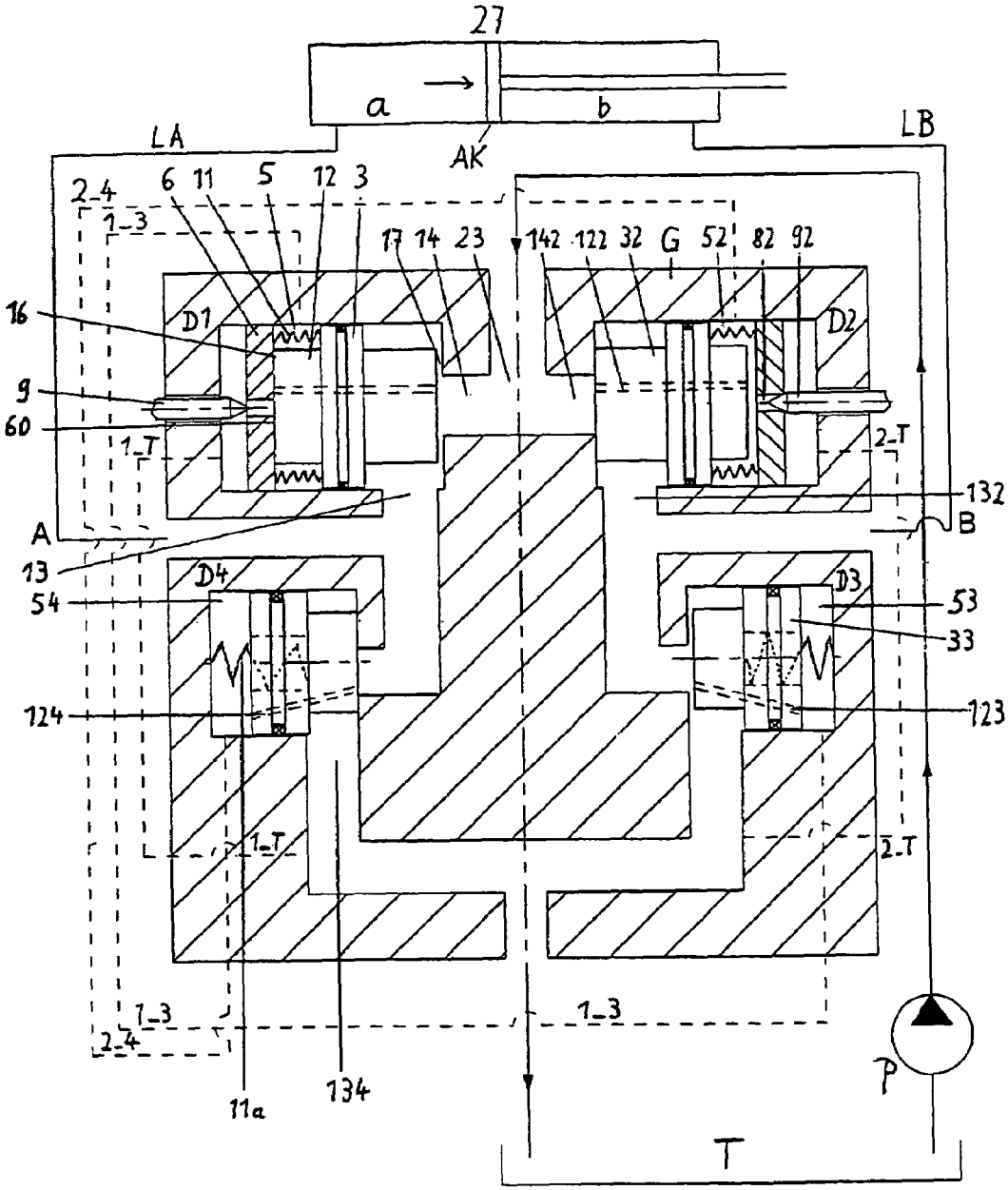

FIG. 4 shows the diagrammatic representation of a servo-valve arrangement constructed in this manner. FIG. 4 is based on the state described in FIG. 3, where D1 and D3 are open, while D2 and D4 are closed, so that the pump pressure (pressure at the outlet of pump P) acts via opened throttle device D1 on working piston AK, in the direction of the arrow in working chamber a of working cylinder 27.

When used in a closed-center system (system having a closed center), the two throttle needles 9 and 92 keep corresponding throttle openings 8, 82 closed in the neutral state. If working piston AK is moved, for example, to the right, then throttle needle 9 is moved to the left, in order to open the throttle opening. In the case of an open-center system, only one of throttle needles 9, 92 (the active one) is pushed into its throttle opening 8, 82 by an actuating force, while no force acts on the other (passive) throttle needle, so that this throttle needle remains outside of its throttle opening. The throttle needles exchange their active and passive roles as a function of the direction in which working piston AK should be displaced.

In FIG. 4, throttle device D1 (and D3) are passive, the pressure conditions (taking into consideration the different sizes of the pressurized surfaces on the two sides of piston 3) ensuring that annular gap 17 is wide open. Since D4 (and D2) are nearly closed (unlike the neutral position of FIG. 1), a pressure greater than the pressure in Tank T prevails at point A, and, in working chamber a, pressure is exerted, via line LA, on working piston AK, in the direction of the arrow.

How is it that D4 is now newly closed? This is based on the fact that D2 is also nearly closed and D4 is controlled by D2, for pressure chamber 52 of D2 is connected to pressure chamber 54 of D4 by a duct 2_4, so that the same pressure prevails in the two pressure chambers.

D2 is nearly closed in the following manner:

First of all, throttle opening 82 of D2 is opened even further, so that fluid may flow relatively unhindered from pump P, via inflow duct 142, through a choke bore 122 in piston 32, and via throttle opening 82 and duct 2_T, to tank T. Then, throttle opening 82 is further closed by moving throttle needle 92 to the left. This causes a higher pressure to build up in pressure chamber 52, which results in piston 32 moving to the left. In this manner, the path from inflow duct 142 to outflow duct 132 (and therefore to point B, to throttle device D3, and to tank T) is nearly closed to the fluid coming from the pump, and the pressure at point B is nearly reduced to the pressure in tank T.

As aspect of the modules manufactured according to an example embodiment of the present invention may be simple and cost-reducing construction. Since sealing is provided here on the end faces, unlike conventional longitudinal slide-valve-sleeve units and rotary slide-valve-sleeve units sealed on the circumference, the fit between the slide and the bore, which fit may be encumbered with tight tolerances and may therefore be expensive to produce, may be omitted. This also may allow special materials and their expensive processing with regard to surface treatment and heat treatment to be omitted. In the case of the described module, a piston and housing made of a light-metal alloy may be sufficient, even for high fluid pressures.

Figure 2:
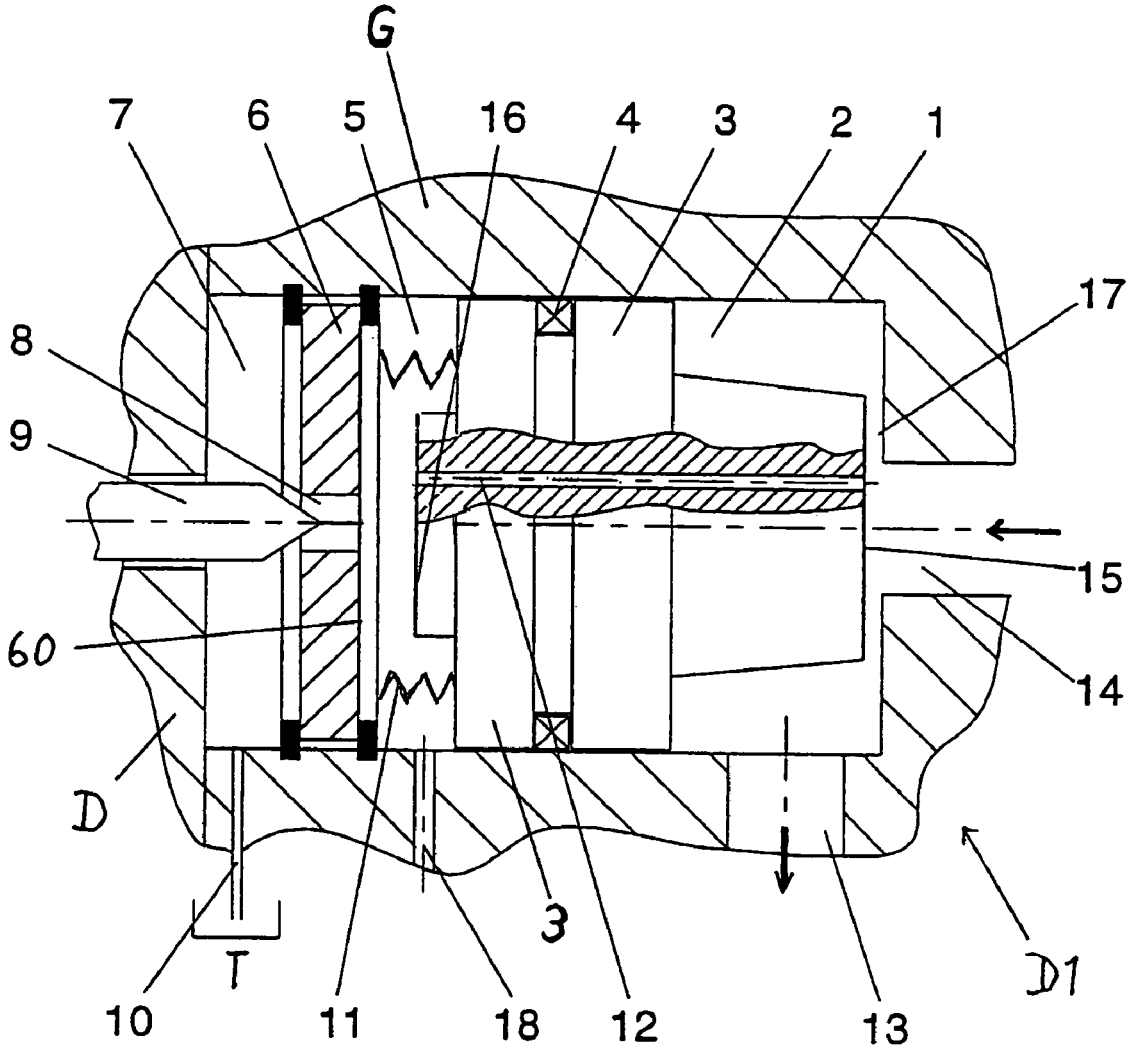

In the neutral position, spring elements 11, which are represented in FIG. 2 and may also be replaced by a large (e.g., recessed) spring element 11*a* (shown in D4 in FIG. 4), have the task of pressing piston 3 in the direction of annular gap 17 in such a manner, that the throttling of the fluid stream in annular gap 17 produces a predefinable pressure difference, which allows a pressure force to be exerted on end face 16 (FIG. 2) of piston 3 in response to the occurrence of the throttling effect at the throttle unit, which is made up of throttle needle 9 and throttle opening 8. The pressure force overcomes the friction of sealing element 4. In addition, this friction is also overcome by the spring force of spring element 11.

Throttle opening 8 is arranged in a disk 6, which forms the rear seal of pressure chamber 5. The fluid flowing through throttle opening 8 into chamber 7 is fed back through line 10 in FIG. 2 (or 1_T in FIG. 4) into tank T of the system.

Represented in FIG. 4 is an operating position, in which module D2 and module D4 are activated and therefore brought into the "closed" position, which means that the fluid stream is directed to working chamber a of working cylinder 27. Modules D1 and D3 are not driven or activated and are therefore in the "open" position. When the system represented in FIG. 4 (or also just the module, which is represented in FIG. 2 and is connected in series to a throttle valve) is used in open-center engineering practice, the high fluid pressure in inflow chamber 23 may produce a very high leakage fluid stream through choke bore 12 in the direction of the tank, which may correspond to a considerable reduction in the moving capacity of working piston AK of working cylinder 27. As aspect of an example embodiment of the present invention is to prevent this.

The disadvantage mentioned above may be prevented according to an example embodiment of the present invention, in which piston 3 may be designed so that precontrol bore 12 opens out at end face 16 of the piston (FIG. 2) and the bore opening there, of the precontrol bore, is closed by the abutting of end face 16 against stop face 60 of disk 6 (or against another appropriate stop face for piston 3), when piston 3 is pressed against stop face 60 of disk 6 (or against another appropriate stop face for piston 3) due to the application of pressure. This situation is represented in module D1 in FIG. 4.

Precontrol bores 12, 122 do not have to be situated in controllable throttle devices D1, D2, but may instead be situated in additionally controlled throttle devices D3, D4 (cf. reference numerals 123 and 124). When throttle device D2 should be controlled so as to pass over from the opened state into the closed state in a FIG. 4 configuration modified in this manner, a precontrol fluid stream will initially flow from pump P through inflow duct 14, outflow duct 13, precontrol bore 124 in the piston of throttle device D4, connecting duct 2_4, pressure chamber 52, throttle opening 82, and connecting duct 2_T, to tank T. When throttle needle 92 is pushed into the throttle opening 82, the pressure in pressure chamber 52 will increase and move piston 32 in the closing direction. The pressure in pressure chamber 54 of D4 simultaneously increases, so that the piston of D4 also moves in the closing direction.

The control device of an example embodiment of the present invention may be suited for hydraulic power-steering systems having an open-center design, because, in this case, the control device may solve the problem of unwanted leakage in the case of annular gap 17 being completely opened. However, the control device of an example embodiment of the present invention may also be suitable for use in a closed-center system.

What is claimed is:

1. A control device for continuous motion of a hydraulic control motor, comprising:

a throttle needle;

two throttle devices arranged in series in a hydraulic flow path between a pump and a tank;

a hydraulic line branching off between the throttle devices, the hydraulic line arranged to lead to a working chamber of the control motor;

wherein a first one of the throttle devices includes a controllable throttle valve having a piston in a housing bore, one side of the piston arranged to support a valve head forming a boundary of an annular gap between an inflow duct and an outflow duct, the throttle needle arranged on another side of the piston arranged in a hydraulic control path, the throttle needle axially movable in a throttle opening and configured to continuously control a pressure drop at the annular gap, the hydraulic control path extending from the inflow duct through the throttle opening to the tank, through a precontrol bore in the piston and through a pressure chamber arranged between the piston and the throttle opening, one end of the precontrol bore positioned on a side of the piston bordering the annular gap in a region of the inflow duct so that the one end of the precontrol bore remains open if the annular gap is closed, another end of the precontrol bore arranged so that the piston, in response to complete opening of the controllable throttle valve, pushes against a stop face to automatically close the another end of the precontrol bore; and wherein the control device is configured to operate according to an open-center principle.

2. The control device according to claim 1, wherein the stop face is arranged as part of a cover for the housing bore.

3. The control device according to claim 1, wherein the stop face is arranged as part of a disk, the throttle opening arranged in the disk.

4. The control device according to claim 1, wherein the pressure chamber is arranged between the piston and the stop face, the pressure chamber including a spring, the piston pressed into a closing position of the controllable throttle valve via the spring.

5. The control device according to claim 1, further comprising a seal element arranged on a largest diameter circumference of the piston, the seal element arranged as a bearing of the piston in the housing bore.

6. The control device according to claim 1, wherein the throttle needle is movable into the throttle opening in accordance with an externally applicable, actuation force.

7. A control device for a hydraulic control motor, comprising:

two structurally identical pairs of throttle devices, each pair including two throttle devices, each throttle device including an axially movable piston, a first throttle device of each pair of throttle devices configured to be controlled in accordance with a throttle needle in a throttle opening, the piston of the first throttle device and a stop face arranged to form a first pressure chamber in a housing bore, a piston of a second throttle device and a housing of the second throttle device arranged to form an additional pressure chamber in hydraulic communication with the first pressure chamber via a line, a throttle device of each pair of throttle devices including a precontrol bore extending from one end face to another end face of the piston and positioned so that a bore opening facing an inflow duct is opened in every piston position and so that another bore opening is closed if the piston is moved against the stop face.

8. The control device according to claim 7, wherein at least one pressure chamber is arranged between the piston and the stop face and includes a spring, the piston pressed into a closing position via the spring.

9. The control device according to claim 7, further comprising a seal element arranged on a largest diameter circumference of the piston, the seal element arranged as a bearing of the piston in the housing bore.

10. The control device according to claim 7, wherein the throttle needle is movable into the throttle opening in accordance with an externally applicable, actuation force.

11. The control device according to claim 7, wherein the precontrol bore is non-aligned with respect to the throttle opening.

12. The control device according to claim 7, wherein the precontrol bore is eccentric with respect to a longitudinal center line of the piston.

13. A control device for a hydraulic control motor, comprising:

two structurally identical pairs of throttle devices, each pair including two throttle devices, each throttle device including an axially movable piston, a first throttle device of each pair of throttle devices configured to be controlled in accordance with a throttle needle in a throttle opening, the piston of the first throttle device and a stop face arranged to form a first pressure chamber in a housing bore, a piston of a second throttle device and a housing of the second throttle device arranged to form an additional pressure chamber in hydraulic communication with the first pressure chamber via a line, a throttle device of each pair of throttle devices including a precontrol bore extending from one end face to another end face of the piston and positioned so that a bore opening facing an inflow duct is opened in every piston position and so than another bore opening is closed if the piston is moved against the stop face, wherein the stop face is arranged as part of a cover for the housing bore.

14. A control device, for a hydraulic control motor, comprising:

two structurally identical pairs of throttle devices, each pair including two throttle devices, each throttle device including an axially movable piston, a first throttle device of each pair of throttle devices configured to be controlled in accordance with a throttle needle in a throttle opening, the piston of the first throttle device and a stop face arranged to form a first pressure chamber in a housing bore, a piston of a second throttle device and a housing of the second throttle device arranged to form an additional pressure chamber in hydraulic communication with the first pressure chamber via a line, a throttle device of each pair of throttle devices including a precontrol bore extending from one end face to another end face of the piston and positioned so that a bore opening facing an inflow duct is opened in every piston position and so than another bore opening is closed if the piston is moved against the stop face, wherein the stop face is arranged as part of a disk, the throttle opening arranged in the disk.

* * * * *